United States Patent [19]

Mazzone

[11] 4,050,190

[45] Sept. 27, 1977

[54] LOCKABLE OBSTRUCTION POST

[76] Inventor: Peter A. Mazzone, 395 Grove St., Apartment 1440, Reno, Nev. 89502

[21] Appl. No.: 680,143

[22] Filed: Apr. 26, 1976

[51] Int. Cl.[2] ..... E01F 13/00

[52] U.S. Cl. ..... 49/35; 49/49

[58] Field of Search ..... 49/49, 35, 131

[56] References Cited

U.S. PATENT DOCUMENTS

| | | | |
|---|---|---|---|
| 3,660,935 | 5/1972 | Boots | 49/35 |

FOREIGN PATENT DOCUMENTS

| | | | |
|---|---|---|---|
| 1,289,862 | 2/1969 | Germany | 49/131 |
| 967,322 | 8/1964 | United Kingdom | 49/131 |

*Primary Examiner*—Philip C. Kannan

*Attorney, Agent, or Firm*—Roylance, Abrams, Berdo & Kaul

[57] ABSTRACT

A tube is supported in a base member mountable at the entrance to a parking space. A pin passes through upstanding walls on the base member and through axially elongated holes in the tube, permitting pivotal and limited axial movement of the tube. A locking rod within the tube is rotatably mounted on the pin and carries a coil spring urging the tube away from the base member. The post is locked in its vertical, obstructing position by pressing the tube downwardly into a socket in the base member and a spring-urged latch then locks the tube to the rod. The latch can be released by a key-operated lock, permitting the coil spring to axially move the tube out of the socket so that the tube can be pivoted to a horizontal, non-obstructing position. Ground-contacting bumpers and a top closure are also provided.

3 Claims, 7 Drawing Figures

LOCKABLE OBSTRUCTION POST

This invention relates to a pivotable post which can be employed as an obstruction to block a parking space or the like and which can be pivoted to an unobstructing position.

In recent years, the concept of "reserving" a parking space or the like by placing a post or similar barrier at the point of access to the parking space and constructing the obstruction so that it can be moved in some fashion has been explored. Various devices have been tried, including posts which can telescope into a receiving device buried in the ground and posts which can be pivoted to a non-obstructing position. Representative of these prior efforts are the following U.S. Pat. Nos.

3,061,960 Dull
3,417,508 Sprung
3,451,164 Kappelman
3,660,935 Boots
3,686,793 d'Hautrhuille
3,688,439 Doxsee
3,698,135 Boots et al
3,750,331 Renaux
3,925,929 Montgomery Various disadvantages have prevented these from being commercially successful. For example, those which telescope into a buried receiver require considerable time and expense in installation. The barriers, including posts, which pivot to a non-obstructing position have the general disadvantages of being excessively complicated in the mechanisms which cause them to be unlocked and pivoted to that position, or which require excessive torque applied to an unlocking key. In some of these prior art devices, it is necessary to go through several movements in order to pivot the post to its horizontal position.

Accordingly, it is an object of the present invention to provide a post of this general type which is simple in construction, has relatively few moving parts, is simple to install, using conventional ground or other anchors, on any available surface and can be unlocked by a key, the apparatus providing very little restraining pressure or reaction torque on the key itself.

Briefly described, the invention comprises the combination of a base member having a generally horizontal portion mounted on a support surface, upstanding spaced-apart walls, and a socket, a pin passing through the walls and defining a pivot axis, an elongated locking rod, means at one end of the locking rod for coupling the rod to the pin to permit the rod to be pivoted about the pivot axis, a tube surrounding the rod, the tube having transversely aligned openings for receiving the pin, the openings being elongated longitudinally relative to the tube to permit limited axial movement of the tube relative to the pin between a first position in which the axis of the tube is substantially vertical and the lower end of the tube engages the socket, and a second position in which the tube is pivotable around the pivot axis to a substantially horizontal position, spring means for urging the tube axially toward the second position, latch means on the tube and engageable with the rod for latching the tube in the first position, and means for releasing the latch means. The means for releasing the latch means can constitute a rotatable key-operated lock. The latch means can include a mounting plate attached to the interior of the tube, the plate having a central opening to slideably receive the rod, a latch member pivotally mounted on the plate for motion toward and away from the rod, and a second spring for urging the latch member toward the rod, the rod having a recess to receive the latch member when the tube is in the first position.

In order that the manner in which the foregoing and other objects are attained in accordance with the invention can be understood in detail, a particularly advantageous embodiment thereof will be described with reference to the accompanying drawings, which form a part of this specification, and wherein.

Figure 1:
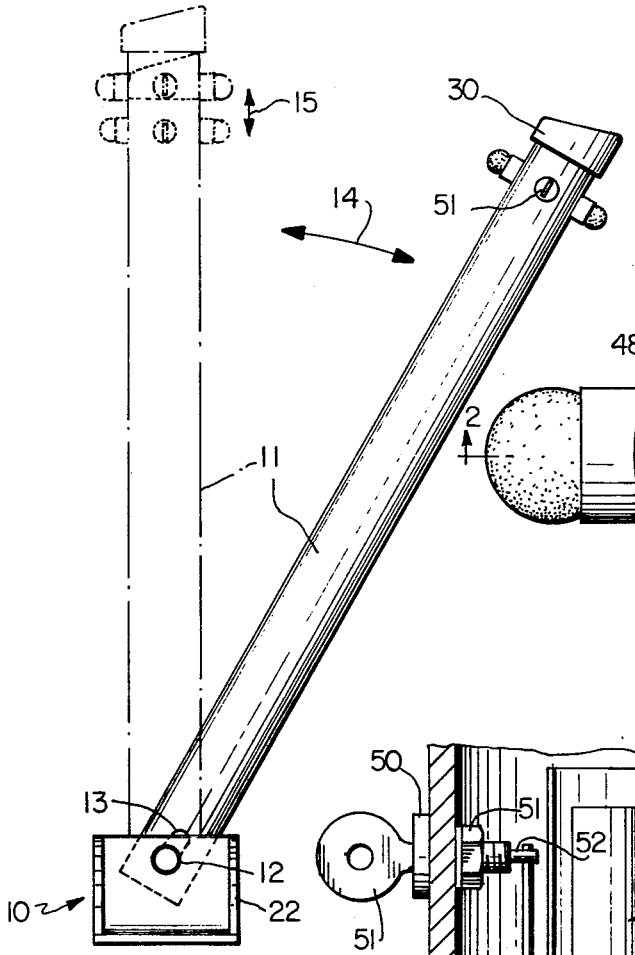
FIG. 1 is a side elevation of a post according to the invention showing the post in its vertical and partly inclined position.

As generally illustrated in FIG. 1, the apparatus includes a base member indicated generally at 10 and a tube 11, the base member having a pin 12 which passes through the base member and through aligned openings 13 in the tube. The openings are elongated in the direction of the longitudinal dimension of the tube so that the tube can be moved axially to a limited degree. As indicated schematically in FIG. 1, when the tube is in its vertical position, it can be pressed downwardly, without the use of a key and without actuating any other mechanical device, to cause it to automatically latch in its vertical position, thereby providing an obstruction. As will be described in greater detail hereinafter, a key can be inserted into a lock and rotated, whereupon the latching mechanism will be released, permitting the tube to spring upwardly in which position it is pivotable about pin 12 and movable, as indicated by arrows 14, to and from a substantially horizontal, ground contacting position, whereupon the parking space or the like can be entered. The vertical movement of the post, to be described subsequently, is indicated by arrows 15.

Figure 5:
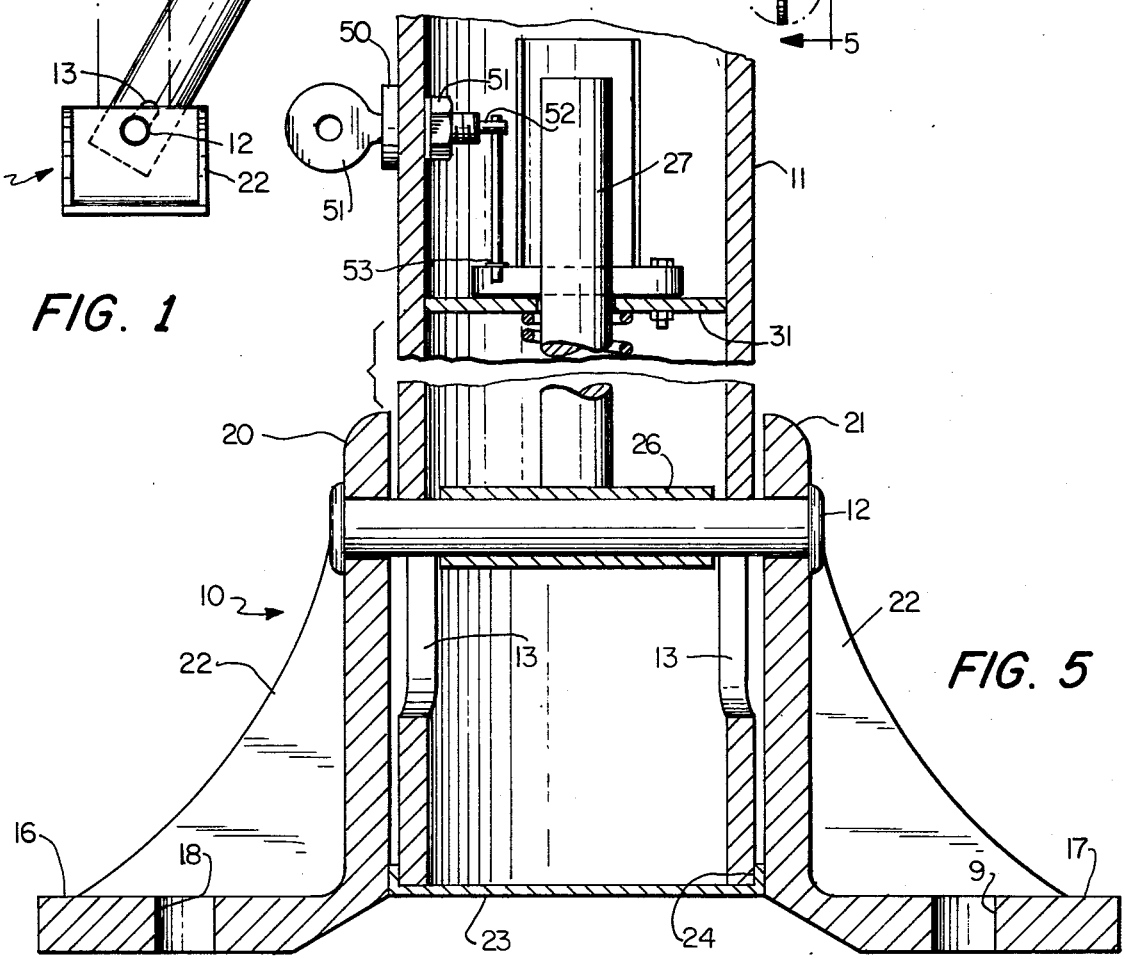
FIG. 5 is a partial side elevation, rotated 90°, of the structure of FIG. 2.
Figure 2:
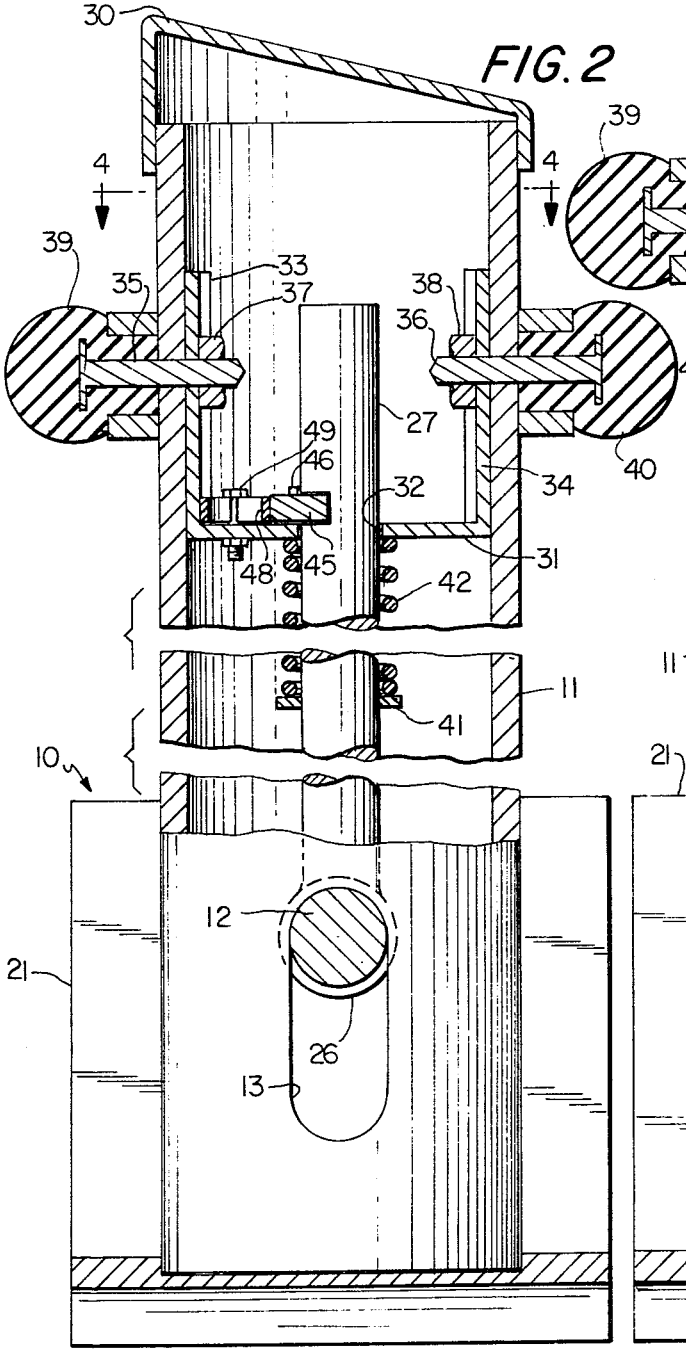
FIGS. 2 and 3 are enlarged side elevations, in partial section, of the post of FIG. 1 in the latched and unlatched positions, respectively.
Figure 3:
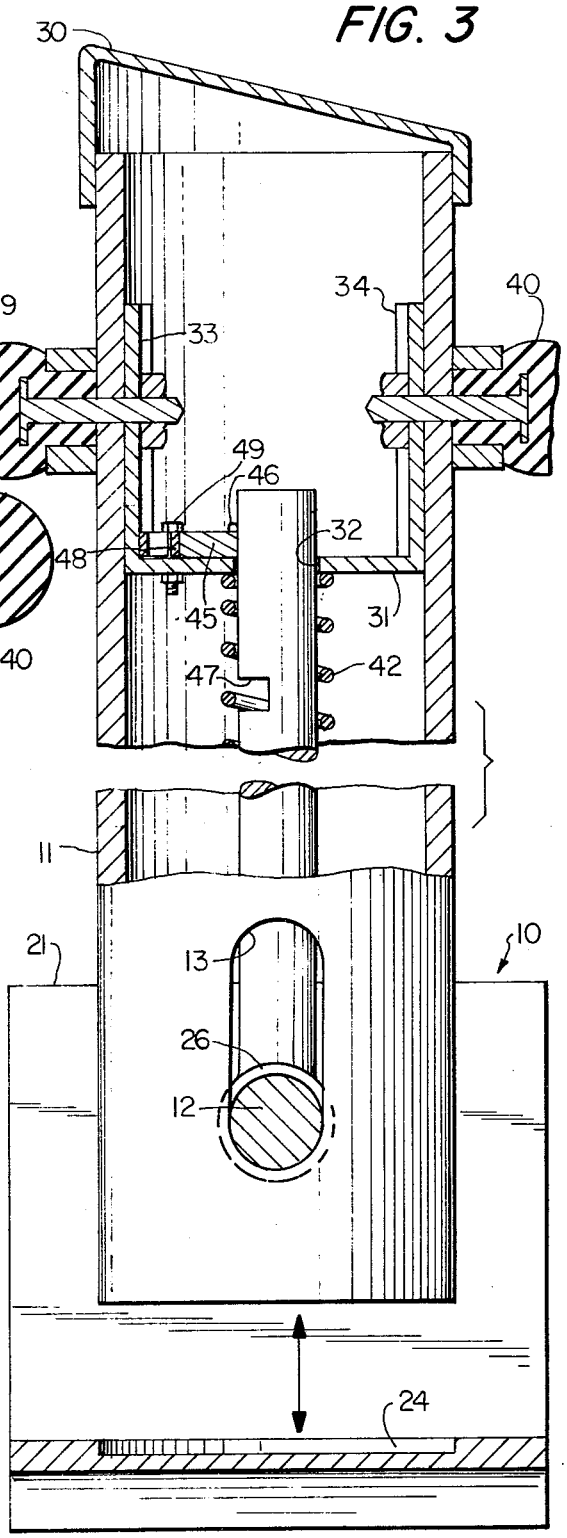

FIGS. 2, 3 and 5 more clearly illustrate the mechanical structure of the device from which its operation will be more clearly understood. Base member 10 includes horizontal portions 16 and 17 having openings 18 and 19 through which bolts, ground anchors or similar devices can be passed to mount the base member on any desired supporting surface. Base member 10 also includes upstanding, spaced-apart, substantially parallel walls 20 and 21 and strengthening webs 22 to provide a strong, rigid structure. A socket member 23 extends between the lower limits of walls 20 and 21, the socket member including a circular recess 24 dimensioned to receive the lower end of tube 11. The entire base member, including socket 23, can be conveniently cast as a single, integrally formed structure. It will also be recognized that opening 24, although shown as a recess, can constitute an opening passing entirely through member 23.

A pin 12, having enlarged ends formed in any convenient fashion during assembly, passes through aligned openings centrally located above recess 24 in walls 20 and 21. Pin 12 can, but need not be, rotatable within walls 20 and 21. A sleeve 26 surrounds the central portion of pin 12 and is rotatable with respect to the pin. An elongated locking rod 27 is fixedly attached, as by welding, to sleeve 26.

Tube 11 surrounds rod 27 and is provided, near its lower end, with previously mentioned openings 13 which are axially elongated and which receive pin 12. Openings 13 are located and dimensioned so that when pin 12 is substantially in contact with the upper limits of openings 13, the lower end of tube 11 extends into recess 24 and, preferably, abuts the lower surface thereof.

As seen in FIGS. 2 and 3, the upper end of tube 11 is closed by a cap 30 which can be attached to the tube by any convenient technique, and which has a slanted top surface to prevent the accumulation of moisture. A mounting plate 31 extends transversely across the interior of tube 11 near the upper end of rod 27, plate 31 having a central opening 32 through which rod 27 extends. Opening 32 is sufficiently large so that rod 27 can freely slide therein. Plate 31 has upwardly extending side portions 33 and 34 by which the mounting plate is fixedly attached to the tube. This attachment can conveniently be accomplished by threaded fasteners 35 and 36 which are held in place by nuts 37 and 38, respectively.

The outer ends of fasteners 35 and 36 are provided with resilient bumpers 39 and 40 which can be molded onto the outer ends of fasteners 35 and 36. Bumpers 39 and 40 protrude beyond the tube a sufficient distance to come in contact with the ground and prevent contact of any portion of the tube, thereby protecting the tube against damage if the post is simply allowed to fall to its horizontal position.

Rod 27 is provided with stop means in the form of a pin or locking washer 41 which is located below the lower surface of mounting plate 31 and engages the lower end of a coil spring 42, the upper end of which abuts plate 31. Spring 42 is a conventional coil compression spring which acts between stop 41 and plate 31 to urge plate 31, and therefore tube 11, in an upward direction.

Figure 4:
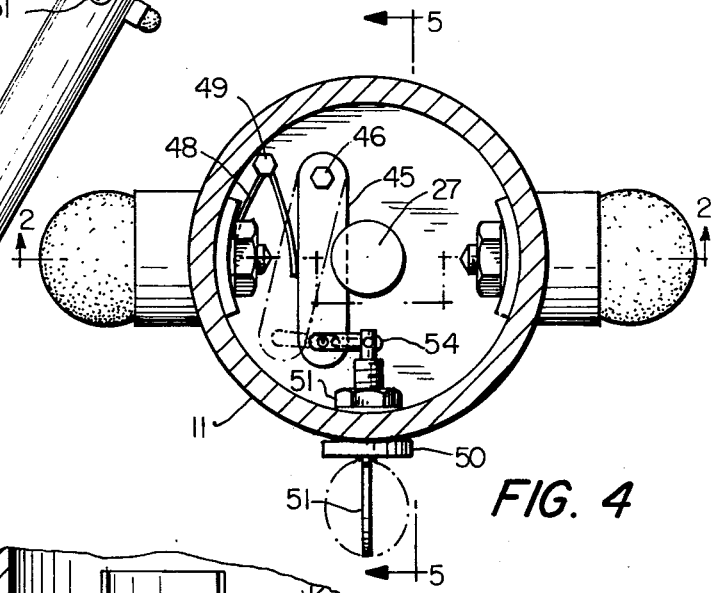
FIG. 4 is a plan view, in partial section, along lines 4—4 of FIG. 2.

Plate 31 supports a latch member 45 which is attached to the upper surface of plate 31 by a conventional threaded fastener such as a shoulder bolt 46, latch member 45 being in the nature of a relatively thick metal bar which is pivotable between the positions illustrated in FIG. 4. In the solid line position, member 45 is received in a recess 47 which extends radially inwardly into one side of rod 27. A leaf spring 48, which is in the general shape of a U or V is also attached to plate 31 by a fastener such as a shoulder bolt 49, one leg of the spring pressing against the inner surface of member 53 and the other leg pressing against one side of latch member 45, tending to urge the latch member toward rod 27 and, if the tube is in its lowermost position, into recess 47.

Figure 6:
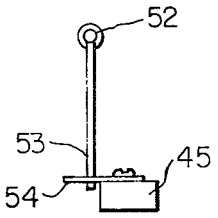
FIGS. 6 and 7 are schematic diagrams showing, in greater detail, the lock and latch releasing mechanism.
Figure 7:
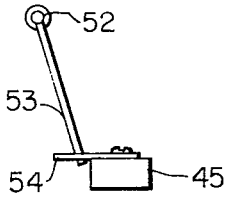

A conventional key-operated cylinder lock 50 is mounted in the wall of tube 11 above plate 31, lock 50 being secured therein by a nut 51 and having a rotatable portion 52 within the tube. A generally downwardly extending link member 53 is fixedly attached to rotatable portion 52 and engages an elongated opening in a horizontal link member 54 which is attached to the distal end of latch member 45. Rotatable portion 52 is caused to rotate when a key 51 is inserted into the lock and turned. As best seen in FIGS. 6 and 7, when rotatable portion 52 is rotated through a relatively small angle, links 53 and 54 cause latch member 45 to move radially outwardly with respect to rod 27, extracting the latch member from recess 47 and permitting the tube to move, under the influence of spring 42, from the position illustrated in FIG. 2 to the position illustrated in FIG. 3.

While it is believed that the operation of the apparatus will be apparent from the foregoing description, the sequence of operation will now be briefly described. Commencing with the structure in the locked position shown in FIG. 2 and illustrated by the lower position shown in phantom lines in FIG. 1, when access to the parking space is desired, key 51 is inserted into lock 50 and turned, rotating portion 52 of the lock and, through linkage members 53 and 54, moving latch member 45 out of recess 47, permitting spring 42 to cause plate 31 and tube 11 to "pop" upwardly to the position shown in FIG. 3, extracting the lower end of the tube from recess 24 and permitting the assembly including the tube and rod to be pivoted about the axis defined by pin 12 to a substantially horizontal ground-contacting position. This permits access to the parking location, the dimensions of the tube being selected so that they do not extend above the ground enough to interfere with a vehicle can be driven across the structure. When the space is again to be obstructed so that unauthorized use of the parking space will be prevented, the tube is pivoted upwardly to its substantially vertical position and simply pressed downwardly. The key need not be present in the lock at this time. As soon as the tube has been pressed downwardly relative to rod 27 to a position at which latch member 45 is adjacent recess 47, spring 48 causes the latch member to enter the recess as shown in FIG. 2, this condition being met when the lower end of tube 11 is within recess 24 in the base member. In this condition, the tube is no longer able to pivot about pin 12 and the apparatus is locked in the vertical position. Release of the mechanism again requires insertion and turning of key 51.

It will be observed that with bumpers on opposite sides of the tube as shown in FIGS. 2, 3 and 4, the post can be employed in a variety of conditions which might require pivoting in either direction. Clearly, more than one post can be employed in conjunction in preventing access to any location and, in addition, a chain can be employed between posts, if desired.

While one advantageous embodiment has been chosen to illustrate the invention, it will be understood by those skilled in the art that various changes and modifications can be made therein without departing from the scope of the invention as defined in the appended claims.

What is claimed is:

1. An obstruction post mountable on a support surface to selectively prevent or permit access to an area adjacent the post comprising the combination of a base member having a generally horizontal portion mountable on the support surface, upstanding, spaced apart walls, and a generally cup-shaped socket;

a pin passing through said walls and defining a pivot axis;

an elongated locking rod;

a sleeve attached to one end of said locking rod and rotatably surrounding said pin for coupling said rod to said pin to permit said rod to be pivoted about said pivot axis;

a tube surrounding said rod;

means in said tube defining transversely aligned openings for receiving said pin, said openings being elongated longitudinally relative to said tube to permit limited axial movement of said tube relative to said pin between a first position in which the axis of said tube is substantially vertical and the lower end of said tube engages said socket, and a second position in which the lower end of said tube is disengaged from said socket so that said tube is pivotable around said pivot axis to a substantially horizontal position;

first spring means for urging said tube axially toward said second position;

latch means within said tube and engageable with said rod for latching said tube in said first position, said latch means comprising a mounting plate fixedly attached to and movable with said tube and extending transversely across the interior of said tube, said plate having a central opening to slideably receive said rod, a latch member pivotally mounted on said plate for motion in a plane perpendicular to the axis of said rod, and second spring means for urging said latch member toward said rod, said rod having a recess to receive said latch member when said tube is moved to said first position; and means for manually releasing said latch means including a key-operated lock mounted in said tube, said lock having a portion within said tube which is rotatable from a locked position to an unlocked position by a key inserted into said lock from outside said tube; and link means connected between said rotatable portion and said latch member for moving said latch member out of said recess when said portion is rotated.

2. A post according to claim 1 wherein said first spring means comprises a compression coil spring surrounding a portion of said rod with one end of said spring abutting a surface of said mounting plate; and stop means fixedly attached to said rod for engaging the other end of said spring.

3. A post according to claim 1 wherein said second spring means comprises a leaf spring having a generally U-shaped configuration, one leg of said leaf spring pressing outwardly toward said tube and the other leg thereof urging said latch member toward said rod; and fastener means for retaining said leaf spring on said mounting plate.

* * * * *